US008554096B2

(12) United States Patent
Sakata

(10) Patent No.: US 8,554,096 B2
(45) Date of Patent: Oct. 8, 2013

(54) POWER SOURCE AND IMAGE FORMING APPARATUS

(75) Inventor: Shiro Sakata, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 356 days.

(21) Appl. No.: 12/730,924

(22) Filed: Mar. 24, 2010

(65) Prior Publication Data

US 2010/0247128 A1 Sep. 30, 2010

(30) Foreign Application Priority Data

Mar. 31, 2009 (JP) ..... 2009-086116

(51) Int. Cl.
*G03G 15/06* (2006.01)

(52) U.S. Cl.
USPC ..... 399/55; 399/50

(58) Field of Classification Search
USPC ..... 399/38, 50, 53–56
See application file for complete search history.

(56) References Cited

U.S. PATENT DOCUMENTS

| | | | | |
|---|---|---|---|---|
| 6,498,908 | B2 * | 12/2002 | Phillips et al. | 399/48 |
| 6,684,036 | B2 * | 1/2004 | Kubota et al. | 399/55 |
| 7,941,064 | B2 * | 5/2011 | Morikuni et al. | 399/55 |

FOREIGN PATENT DOCUMENTS

| | | | |
|---|---|---|---|
| JP | 1-114876 | A | 5/1989 |
| JP | 03-001664 | A | 1/1991 |
| JP | 6-003932 | A | 1/1994 |
| JP | 2004-184988 | A | 7/2004 |
| JP | 2006-162893 | A | 6/2006 |
| JP | 2007-072093 | A | 3/2007 |
| JP | 2007-316147 | A | 12/2007 |
| JP | 2009-180882 | A | 8/2009 |

* cited by examiner

*Primary Examiner* — Hoan Tran
(74) *Attorney, Agent, or Firm* — Canon USA, Inc., IP Division

(57) ABSTRACT

A power source includes a charging voltage generation unit configured to generate a charging voltage to charge an image bearing member, a developing voltage generation unit configured to generate a developing voltage to develop an electrostatic latent image formed on the image bearing member, a control unit configured to control an output from the developing voltage generation unit, and a correction unit configured to correct an operation of the control unit based on an output from the charging voltage generation unit.

20 Claims, 18 Drawing Sheets

PRIOR ART

PRIOR ART

PRIOR ART

CURRENT CIRCUIT

PRIOR ART

ASSOCIATED CIRCUIT

PRIOR ART

POWER SOURCE AND IMAGE FORMING APPARATUS

BACKGROUND OF THE INVENTION

1. Field of the Invention

The present invention relates to an image forming apparatus and a power source that outputs a high voltage for image formation.

2. Description of the Related Art

An image forming apparatus will be described by using a printer as an example. The printer conventionally includes a mechanism illustrated in FIG. 12. In FIG. 12, the printer includes the following units. A photosensitive drum 101 is an image bearing member. A semiconductor laser 102 is a light source. A rotational polygonal mirror 103 is rotated by a scanner motor 104. A laser beam 105 is emitted from the semiconductor laser 102 to scan the photosensitive drum 101.

A charging roller 106 is configured to uniformly charge the photosensitive drum 101. A developing device 107 is a developer to develop an electrostatic latent image formed on the photosensitive drum 101 by toner. A transfer roller 108 is configured to transfer a toner image developed by the developing device 107 to recording paper. A fixing roller 109 is configured to fix the toner image transferred to the recording paper by heat.

A cassette feeding roller 110 feeds a sheet from a cassette which identifies a size of the recording paper to a conveyance path by rotating one round. A manual feeding roller 111 feeds a sheet from a manual feeding port which does not identify the size of the recording paper to the conveyance path. An optional cassette feeding roller 112 feeds a sheet from a detachable cassette which identifies the size of the recording paper to the conveyance path. An envelope feeder feeding roller 113 feeds sheets one by one from a detachable envelope feeder on which only envelopes can be loaded to the conveyance path. Conveyance rollers 114 and 115 are configured to convey sheets fed from the cassette.

A pre-feed sensor 116 detects a leading edge and a trailing edge of a sheet fed from other than the envelope feeder. A pre-transfer roller 117 feeds the conveyed sheet to the photosensitive drum 101. A top sensor 118 synchronizes image drawing (recording/printing) to the photosensitive drum 101 with sheet conveyance for the fed sheet and to measure a length of the fed sheet in a conveying direction. A sheet discharge sensor 119 detects presence or absence of a sheet after fixing. A discharge roller 120 discharges the sheet after fixing out of the apparatus.

A flapper 121 switches a conveyance destination (to out of the apparatus or to detachable two-sided unit) of a printed sheet. A conveyance roller 122 conveys a sheet conveyed to the two-sided unit to a reversing unit. A reversing sensor 123 detects a leading edge or a trailing edge of the sheet conveyed to the reversing unit. A reversing roller 124 reversed the sheet and convey the sheet to a re-feeding unit by sequentially rotating forward and backward. A re-feeding sensor 125 detects presence or absence of a sheet of the re-feeding unit. A re-feeding roller 126 feeds the sheet of the re-feeding unit again to the conveyance path.

FIG. 13 is a block diagram illustrating a circuit structure of a control system for controlling such mechanical units. In FIG. 13, a printer controller 1201 rasterizes image code data transmitted from an external device such as a host computer (not illustrated) into bit data necessary for printing in the printer, and reads and displays printer internal information. A printer engine control unit 1202 controls an operation of each unit of a printer engine according to an instruction from the printer controller 1201, and notifies the printer controller 1201 of the printer internal information.

A sheet conveyance control unit 1203 drives or stops a motor or a roller for conveying the recording paper according to an instruction from the printer engine control unit 1202. A high voltage control unit 1204 performs output control of high voltage in each process such as charging, developing and transfer according to the instruction from the printer engine control unit 1202.

An optical system control unit 1205 controls driving or stopping of the scanner motor 104 and lighting of a laser beam according to the instruction from the printer engine control unit 1202. A fixing temperature control unit 1207 adjusts a temperature of a fixing device to a temperature instructed by the printer engine control unit 1202.

An optional cassette control unit 1208 drives or stops a driving system according to the instruction from the printer engine control unit 1202, and notifies the printer engine control unit 1202 of a paper presence state and paper size information.

A detachable two-sided unit control unit 1209 performs sheet reversing and a re-feeding operation according to the instruction from the printer engine control unit 1202, and notifies the printer engine control unit 1202 of operation states thereof at the same time.

An envelope feeder control unit 1210 drives or stops the driving system according to the instruction from the printer engine control unit 1202, and notifies the printer engine control unit 1202 of a paper presence state.

As a high voltage output value, there is a voltage (hereinafter, referred to as a bias) for which a predetermined voltage difference is correlatively required for individual outputs. Examples are outputs of a charging direct current (DC) voltage and a developing DC voltage. A difference between these two bias values affects an image density (contrast).

FIG. 14 illustrates schematic configurations of charging and developing DC bias application circuits 701 and 801. The charging DC bias application circuit unit 701 includes a voltage setting circuit unit 702 which can change a set value according to a pulse width modulation (PWM) signal, a transformer driving circuit unit 703, a high voltage transformer 704, and a feedback circuit unit 705. The feedback circuit unit 705 detects a voltage value applied to a load by a resistance R71, and transmits the detected voltage value as an analog value to the voltage setting circuit unit. Based on this value, control is performed so as to apply a fixed voltage.

The developing DC bias application circuit unit 801 includes a voltage setting circuit unit 802 which can change a set value according to a PWM signal, a transformer driving circuit unit 803, a high voltage transformer 804, and a feedback circuit unit 805. The feedback circuit unit 805 detects a voltage value applied to a load by a resistance R81, and transmits the detected voltage value as an analog value to the voltage setting circuit unit. Based on this value, control is performed so as to apply a fixed voltage.

With this configuration, constant voltage values can be applied at the charging DC bias application circuit unit and the developing DC bias application circuit unit by performing a series of control operations. Apparatuses with such configurations are discussed in Japanese Patent Application Laid-Open Nos. 2006-162893 and 6-3932.

In the DC bias circuit structure, each voltage value is controlled constant. By improving accuracy of an output voltage at each circuit, accuracy of a difference (e.g., contrast voltage) in voltage values between the biases is improved.

Increasing print speeds has been accompanied by an image problem such as density variance at conventional high voltage accuracy. In other words, the apparatus is operated at higher speed so as to increase the number of prints (number of formed images) per unit time, and hence voltage control for correcting an image density may not be in time. In the case of achieving higher image quality, the conventional high voltage circuit structure cannot sufficiently correct variance on voltage accuracy for correcting image density variance in a page or between pages. To realize control with a higher voltage accuracy, shift to a control method is required which does not control each bias variance but controls an output voltage in association between biases.

These problems will be described below more in detail. As examples, FIGS. 15A and 15B illustrate a potential (Vd) of a charging DC bias and a potential (Vdc) of a developing DC bias. The photosensitive drum is set to a potential VL after laser irradiation. In the current circuit structure in FIG. 15A, the potential Vd changes to cause a change in potential difference between Vdc and Vd, and a margin to an image failure (referred to as a fogged image) where an image is unnecessarily developed is reduced. A potential difference between VL and Vdc also changes and causes a reduction in a margin before image density unevenness occurs. However, as illustrated in FIG. 15B, if output control associating biases with each other is performed, even when the potential Vd changes, the potential difference between Vdc and Vd is kept constant and the potential difference between VL and Vdc is kept constant.

In the developing processing, an electrostatic adsorption power applied to toner depends on the potential difference between VL and Vdc. Thus, when the potential difference between VL and Vdc is constant, a force applied to the toner is constant, and a density of toner adsorbed on the photosensitive drum is constant. Thus, a margin to a fogged image or image density unevenness may not reduce.

As other examples, FIGS. 16A and 16B illustrate a potential (Vdc) of a developing DC bias and a potential (Vrb) of a developing blade bias. The developing blade bias is provided for the purpose of charging charges of toner itself close to a developing DC bias value, and it is necessary to be set close to a developing DC bias output. However, when a developing blade bias is output at a potential equal to or a plus side of a developing DC bias, toner is fixed to the developing blade to cause an image failure. Thus, a predetermined minus potential difference with respect to the developing DC bias is necessary for the developing blade bias.

In the current circuit structure in FIG. 16A, the potential Vdc changes to cause a change in potential difference between Vdc and Vrb, and a margin to charging of toner and a margin to toner fixing are reduced. However, as illustrated in FIG. 16B, when output control associating biases with each other is performed, even if the potential Vdc changes, the potential difference between Vdc and Vrb is kept constant, and the margin to the potential for charging the toner does not reduce.

SUMMARY OF THE INVENTION

The present invention is directed to an image forming apparatus that can stabilize a difference between required biases at a predetermined value.

According to an aspect of the present invention, an image forming apparatus includes an image bearing member, a charging unit configured to charge the image bearing member, a latent image forming unit configured to form an electrostatic latent image on the image bearing member charged by the charging unit, and a development unit configured to develop the electrostatic latent image formed on the image bearing member by a developer. The image forming apparatus further includes, a charging voltage generation unit is configured to generate a charging voltage to be applied to the charging unit, a developing voltage generation unit is configured to generate a developing voltage to be applied to the development unit, a control unit is configured to control an output from the developing voltage generation unit, and a correction unit which is connected to the control unit and configured to correct an operation of the control unit based on an output from the charging voltage generation unit.

According to another aspect of the present invention, an image forming apparatus includes an image bearing member, a development unit configured to supply a developer to an electrostatic latent image formed on the image bearing member, and a development member configured to adjust an amount of the developer in the development unit. The image forming apparatus further includes a first developing voltage generation unit configured to generate a first developing voltage to be applied to the development unit, a second developing voltage generation unit configured to generate a second developing voltage to be applied to the development member, a control unit configured to control an output from the second developing voltage generation unit, and a correction unit which is connected to the control unit and configured to correct an operation of the control unit based on an output from the first developing voltage generation unit.

According to yet another aspect of the present invention, a power source for supplying a high voltage includes a charging voltage generation unit configured to generate a charging voltage to be applied to a charging unit for charging an image bearing member, a developing voltage generation unit configured to generate a developing voltage to be applied to a development unit for developing an electrostatic latent image formed on the image bearing member by a developer, a control unit configured to control an output from the developing voltage generation unit, and a correction unit which is connected to the control unit and configured to correct an operation of the control unit based on an output from the charging voltage generation unit.

According to yet another aspect of the present invention, a power source for supplying a high voltage includes a first developing voltage generation unit configured to generate a first developing voltage to be applied to a development unit for supplying a developer to an electrostatic latent image formed on an image bearing member, a second developing voltage generation unit configured to generate a second developing voltage to be applied to a development member for adjusting an amount of the developer in the development unit, a control unit configured to control an output from the second developing voltage generation unit, and a correction unit which is connected to the control unit and configured to correct an operation of the control unit based on an output from the first developing voltage generation unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A first exemplary embodiment will be described.

Figure 1:
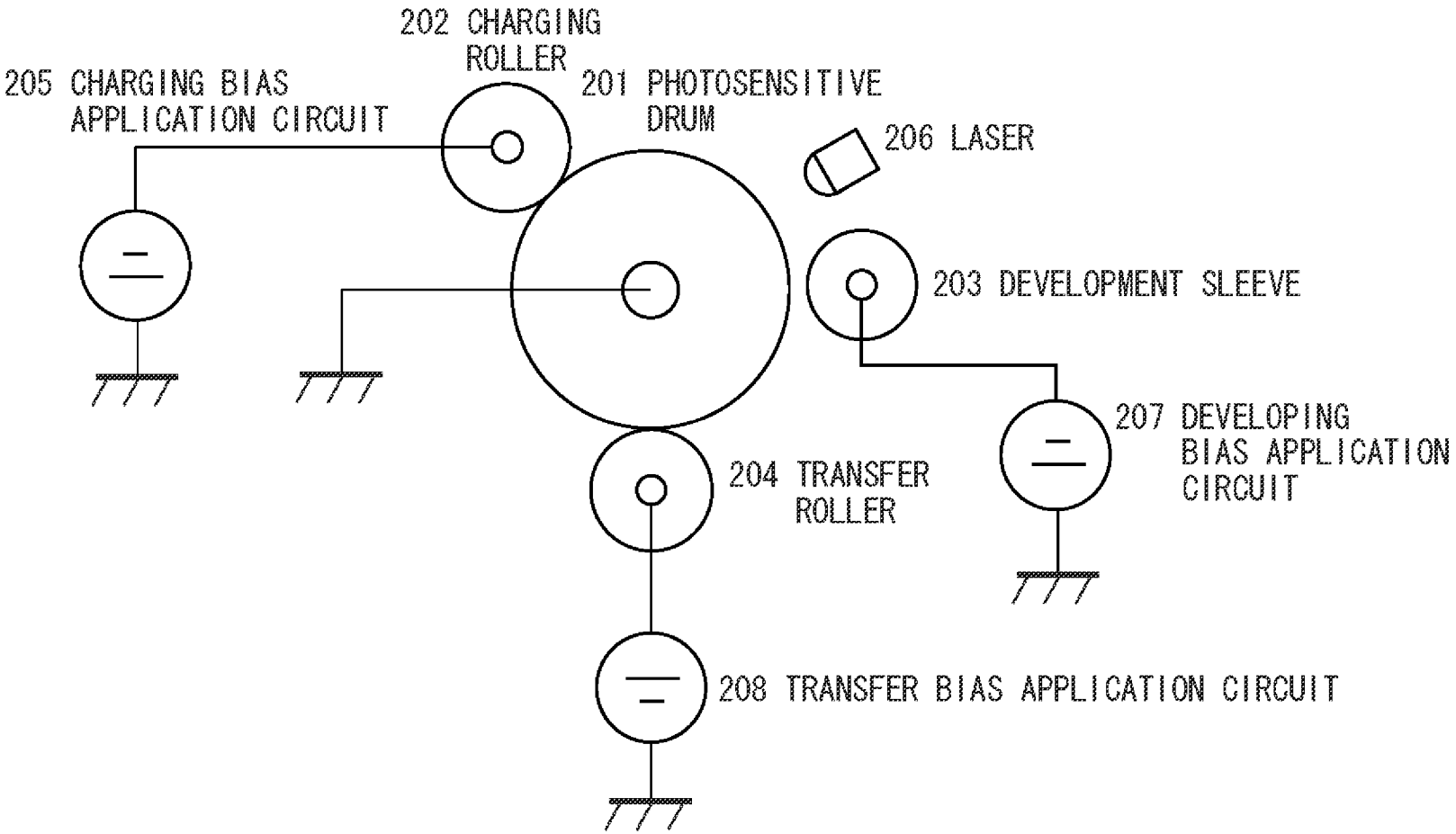
FIG. 1 is a cross sectional diagram schematically illustrating a configuration of an image forming apparatus according to a first exemplary embodiment.

FIG. 1 is a cross sectional diagram schematically illustrating a configuration of an image forming apparatus according to the first exemplary embodiment. In FIG. 1, the image forming apparatus includes a photosensitive drum 201 that is an image bearing member, a charging roller 202 configured to uniformly charge the photosensitive drum, a development roller (development sleeve) 203 configured to develop an electrostatic latent image formed on the image bearing member using toner as a developer. The image forming apparatus further includes a transfer roller 204 configured to transfer the toner image developed on the image bearing member to recording paper, a charging bias application circuit 205, a laser light source 206 configured to form an electrostatic latent image by exposing the photosensitive drum charged according to image data with an light beam based on the image data, a developing bias application circuit 207, and a transfer bias application circuit 208. The developing bias application circuit 207 and the transfer bias application circuit 208 are provided as power sources in the image forming apparatus. In the power sources, respective circuits are configured according to application targets. In the description below of the exemplary embodiments, a bias means a high voltage necessary for performing image formation.

Figure 2:
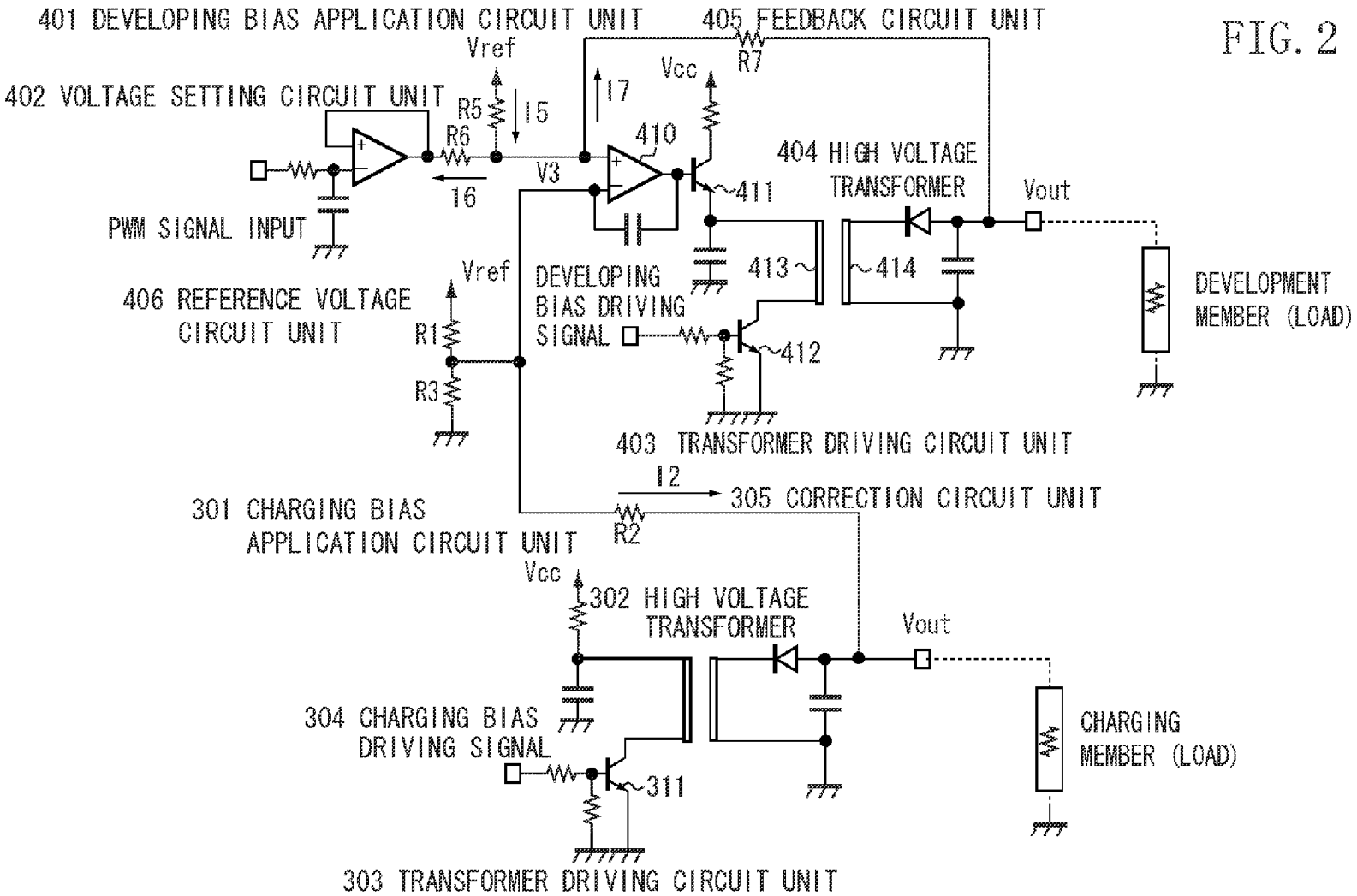
FIG. 2 is a circuit diagram illustrating a charging bias circuit and a developing bias circuit according to the first exemplary embodiment.

FIG. 2 schematically illustrates configurations of a charging bias application circuit unit 301 and a developing bias application circuit unit 401 that are main units of the present exemplary embodiment. The charging bias application circuit unit 301 that is a charging bias power source circuit includes a high voltage transformer 302, a transformer driving circuit unit 303, and a charging bias driving signal 304 for driving the transformer. An open loop circuit structure is realized which can change a high voltage output by making a frequency of the charging bias driving signal and Duty variable and which needs no feedback circuit. The charging bias circuit is configured by this circuit structure. A feedback circuit unit 305 includes a resistance R2 configured to reflect a charging bias output in the developing bias application circuit, and is connected to a reference voltage circuit unit 406 of the developing bias application circuit. The feedback circuit unit is a correction circuit that corrects an operation of a control circuit of the developing bias application circuit unit.

In the developing bias application circuit unit 401 that is a developing bias power source circuit, a voltage setting circuit 402 can change a high voltage output according to a PWM signal input. The voltage setting circuit 402 includes a PWM signal smoothing circuit and resistances R5 and R6 for voltage conversion. The developing bias application circuit unit 401 includes a transformer driving circuit unit 403, a high voltage transformer 404, a feedback circuit unit 405 configured to monitor an output voltage via a resistance R7 and set an output voltage value according to setting of the PWM signal, and a reference voltage circuit unit 406 constituted of resistances R1 and R3. The reference voltage circuit unit 406 is a part of the control circuit of the developing bias application circuit unit.

A PWM signal and a feedback signal are applied to a positive input terminal of an operation amplifier 410, and a reference voltage is applied to its negative input terminal. An output terminal of the operation amplifier 410 is connected to a base of a transistor 411 serially connected to a primary winding 413 of the high voltage transformer 404. Thus, the reference voltage is one of the elements including the PWM signal and the feedback signal to determine an output voltage of the developing bias application circuit unit 401.

Employing the configuration in which the reference voltage as one of the elements to determine the output voltage of the developing bias application circuit unit 401 is corrected based on an output of the charging bias application circuit unit 301 enables control of a developing bias in association with a change in charging bias. Accordingly, a constant contrast voltage can be obtained.

An example in which contrast is constant will be described below. In setting of constants, i.e., Vref: 18 V, R1: 10 kΩ, R3: 50 kΩ, R2: 1 MΩ, R5: 50 kΩ, R6: 100 kΩ, and R7: 4 MΩ, when a charging bias output: −700 V and a PWM smoothing voltage (V3): 2 V are set, a current I2: 709 μA flows from the reference voltage circuit unit 406 of a developing bias to a charging bias, and a negative input voltage (Vop) of the operation amplifier 410 becomes 9.09 V because of setting of the Vref and R1 and R3. Based on this value and voltage setting of the PWM smoothing voltage (V3) and Vref, I5: 178 μA, I6: 71 μA, and I7: 107 μA are set. The current of I7: 107 μA flows to R7: 4 MΩ, and hence an output voltage of 4 MΩ*107 μA=−429 V is set. Thus, a contrast voltage becomes Δ271 V (700 V−429 V).

In this setting, when a change of Δ20 V occurs in charging bias due to a load change or transformer variance, a charging bias output: −720 V is set. In this case, when the PWM smoothing voltage (V3): 2 V is set, a current of I2: 729 μA flows from the reference voltage circuit unit 406 of the developing bias to the charging bias, and an input voltage (Vop)= 8.925 V of the operation amplifier is set in setting of Vref and R1 and R3. Based on this value and the voltage setting of the PWM smoothing voltage (V3) and Vref, currents of I5: 181 μA, I6: 69 μA, and I7: 112 μA are set. The current of I7: 112 μA flows to R7: 4 MΩ, and hence an output voltage of 4 MΩ*112 μA=−449 V is set, which is a voltage corresponding to a change amount 20 V of the charging bias. The contrast voltage is kept constant at Δ271 V (720V−449 V).

Tables 1 and 2 describe voltage and current values of the above described points:

TABLE 1

| Reference | | | |
|---|---|---|---|
| Vref (V) | 18 | V3 (V) | 2 |
| R1 (Ω) | 10000 | V4 (V) | 18 |
| R3 (Ω) | 50000 | R5 (Ω) | 50000 |
| R2 (Ω) | 1000000 | R6 (Ω) | 100000 |
| V2 (V) (Charging DC output) | −700 | I5 (A) | 0.000178 |
| | | I6 (A) | −7.1E−05 |
| Vop (V) | 9.090909 | I7 (A) | 0.000107 |
| | | R7 (Ω) | 4000000 |
| | | Vout (Developing DC output) | −429 |
| | | Contrast | −271 |

TABLE 2

| Even in the case where load change/component variance causes change in charging can be dealt with | | | |
|---|---|---|---|
| Vref (V) | 18 | V3 (V) | 2 |
| R1 (Ω) | 10000 | V4 (V) | 18 |
| R3 (Ω) | 50000 | R5 (Ω) | 50000 |
| R2 (Ω) | 1000000 | R6 (Ω) | 100000 |
| V2 (V) (Charging DC output) | −720 | I5 (A) | 0.000181 |
| | | I6 (A) | −6.9E−05 |
| Vop (V) | 8.92562 | I7 (A) | 0.000112 |
| | | R7 (Ω) | 4000000 |
| | | Vout (Developing DC output) | −449 |
| | | Contrast | −271 |

Figure 3:
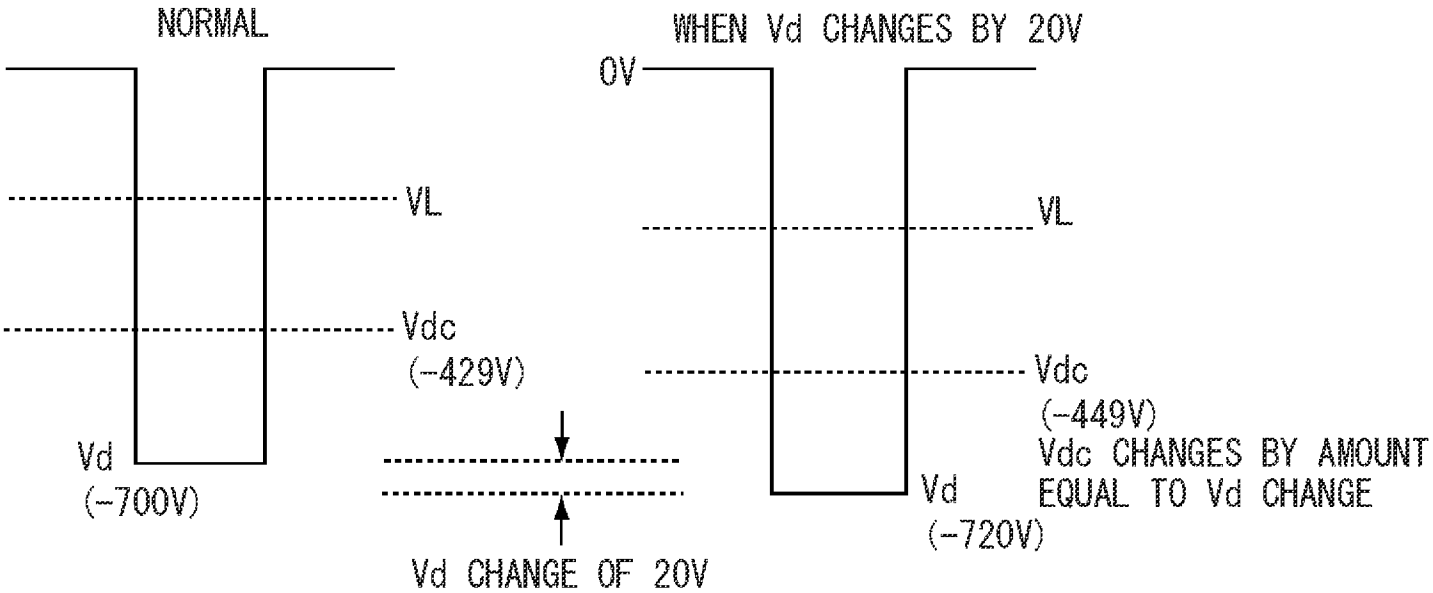
FIG. 3 illustrates potentials of main units according to the first exemplary embodiment.

FIG. 3 illustrates potentials in the above case.

Figure 4:
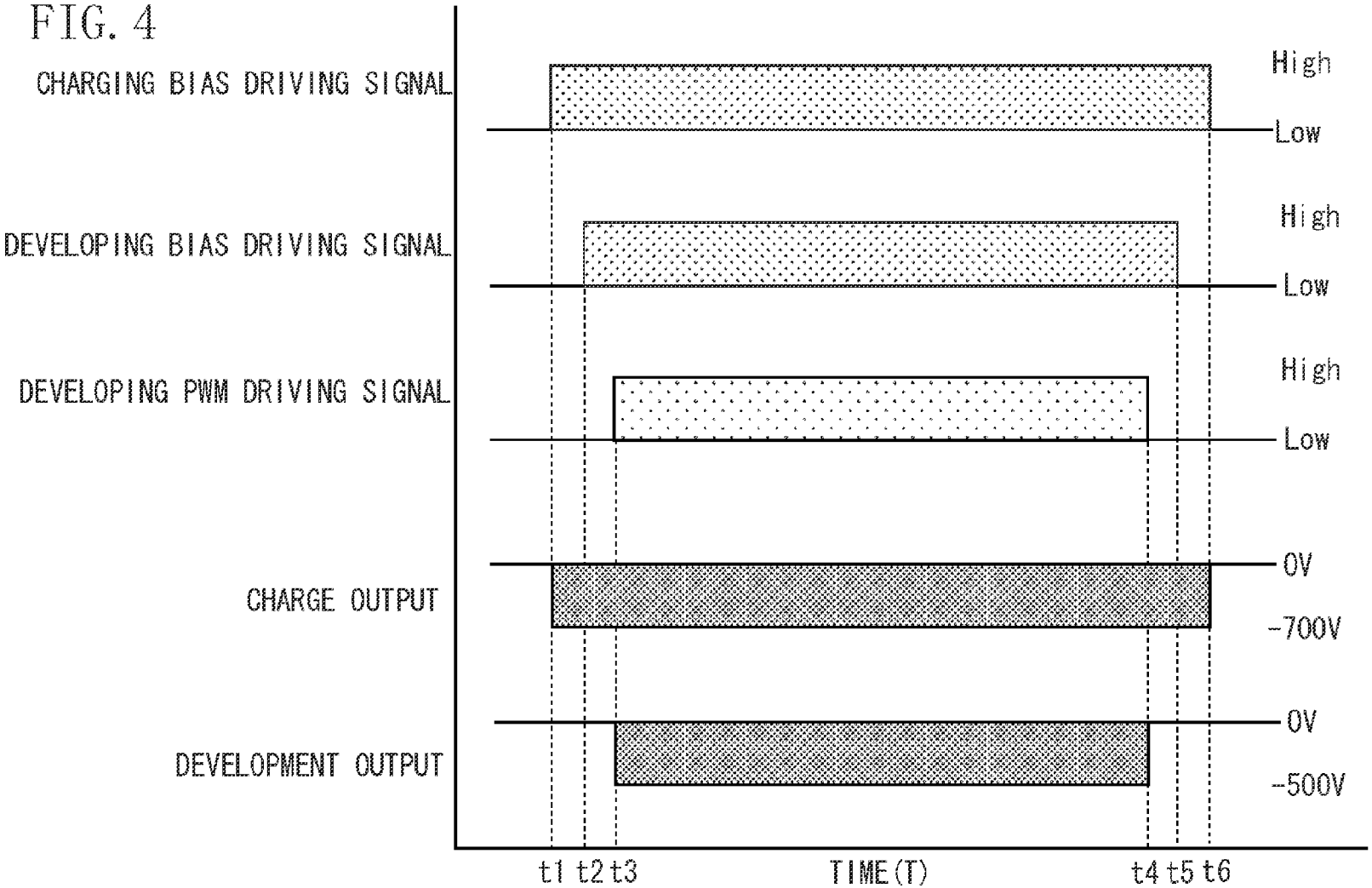
FIG. 4 is a timing chart of the main units according to the first exemplary embodiment.

FIG. 4 is a timing chart of the present exemplary embodiment.

At the time of output rising, a charging bias driving signal is turned ON (t1), and then a developing bias driving signal ON (t2) and a developing PWM signal ON (t3) are sequentially input. The entry of the signals in this order results in outputting of a charging bias, and subsequent outputting of a developing bias to which a value of the charging bias has been added.

At the time of output falling, in order to surely output a developing bias to which a charging bias has been added during sheet passing, the developing PWM signal is turned OFF (t4), and then the developing bias driving signal and the charging bias driving signal are respectively turned OFF (t5) and (t6) in this order. Turning the signals ON/OFF by such timing enables sure outputting of a developing bias to which a change in the charging bias has been added during sheet passing.

Application of a developing bias to a portion of the photosensitive drum 201 to which no charging bias has been applied results in useless flying of toner thereto. A time difference is always generated due to distance deviation in position facing to the photosensitive drum between the charging roller 202 and the development speed 203. Thus, time differences between t1 and t3 and between t4 and t6 are important. No time difference may be necessary between t2 and t3 or between t4 and t5. However, a time difference is advisably set in order to prevent output overshooting.

Controlling signal output timing based on the above described circuit structure and constant settings of the circuit elements enables output control associating biases with each other (developing DC voltage and charging DC voltage). In other words, even when the potential Vd changes, a potential difference between Vdc and Vd is kept constant, and a potential difference between VL and Vdc is kept constant. Accordingly, a possibility of occurrence of image fogging or image density unevenness can be reduced. Therefore, a constant contrast potential not affected by a change in a charging bias can be obtained, and a high quality image can be formed. A change in image density can be realized by changing setting of PWM of the developing bias application circuit unit.

Next, a second exemplary embodiment will be described.

An image forming apparatus according to the second exemplary embodiment will be described. An overall configuration of the present exemplary embodiment is similar to that of the first exemplary embodiment, and thus description thereof will be omitted.

The present exemplary embodiment is an example where each bias circuit includes a feedback control circuit configured to stabilize an output. In other words, the image forming apparatus includes a feedback-controlled charging bias application circuit and a feedback-controlled developing bias application circuit. A high voltage power source is provided to stabilize a difference between output values to a predetermined value.

More specifically, an output of the feedback-controlled charging bias application circuit is supplied to a control unit of the feedback-controlled developing bias application circuit via a resistance. Thus, the high voltage power source can control a difference between a charging bias and a developing bias at constant by performing control to output a developing bias associated with a charging bias change caused by constant variance of the charging bias circuit or a load change.

Figure 5:
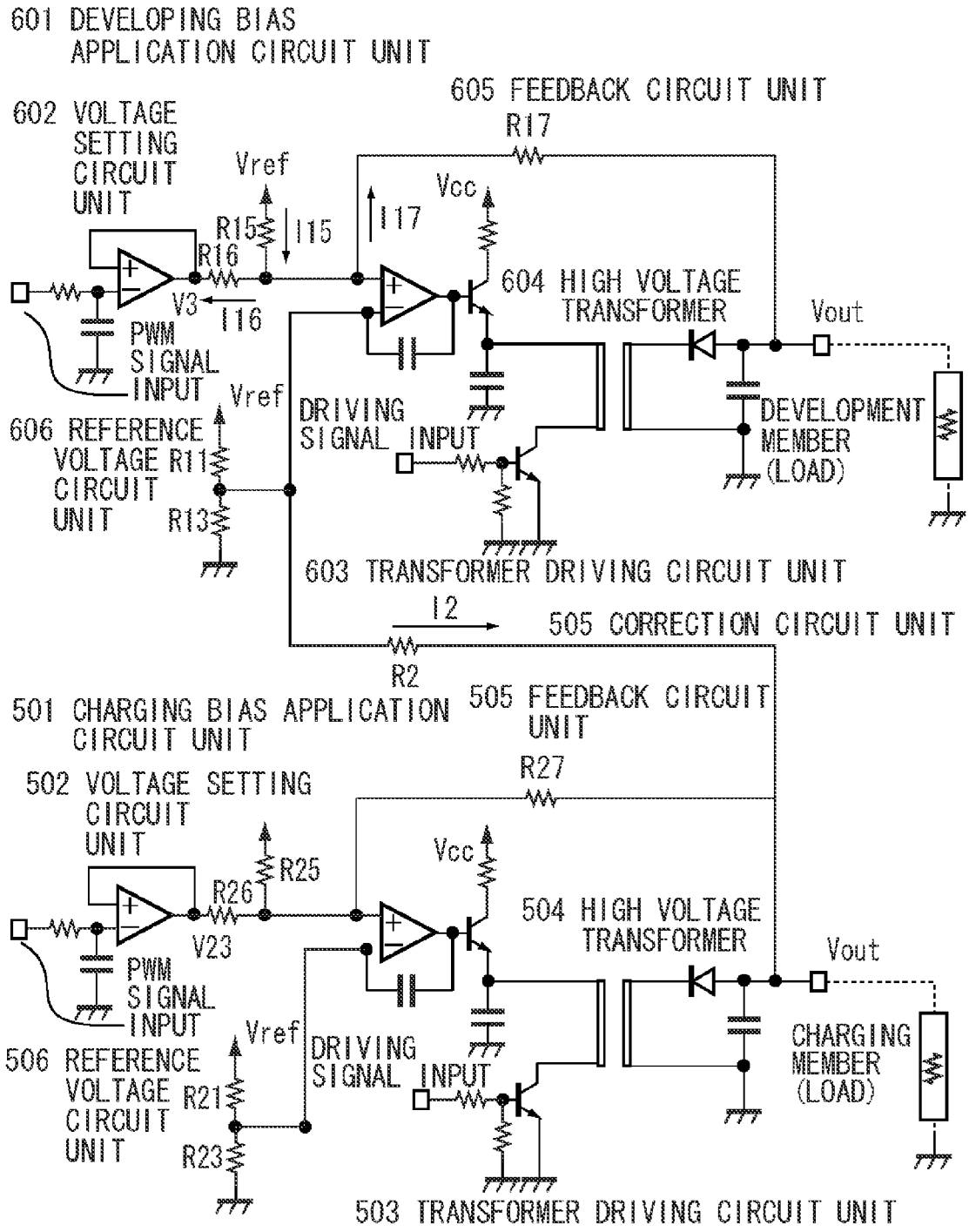
FIG. 5 is a circuit diagram illustrating a charging bias circuit and a developing bias circuit according to a second exemplary embodiment.

FIG. 5 schematically illustrates configurations of a charging bias application circuit unit 501 and a developing bias application circuit unit 601 according to the present exemplary embodiment. In the charging bias application circuit 501, a voltage setting circuit unit 502 can change a high voltage output according to a PWM signal. The voltage setting circuit unit 502 includes a PWM signal smoothing circuit and resistances R25 and R26 for voltage conversion. The charging bias application circuit unit 501 includes a transformer driving circuit unit 503, a high voltage transformer 504, a feedback circuit unit 505 configured to monitor an output voltage via a resistance R27 and set an output voltage value according to setting of the PWM signal.

The charging bias application circuit unit 501 further includes a reference voltage circuit unit 506 constituted of resistances R21 and R23. These circuit components constitute the charging bias circuit. The feedback circuit unit 505 that reflects a charging bias output in the developing bias application circuit includes a resistance R12, and is connected between an output terminal of the charging bias application circuit unit 501 and a reference voltage circuit unit 606 of the developing bias application circuit unit 606.

In the developing bias application circuit unit 601, the voltage setting circuit unit 602 can change a high voltage output according to a PWM signal, and includes a PWM signal smoothing circuit and resistances R15 and R16 for voltage conversion. The developing bias application circuit unit 601 includes a transformer driving circuit unit 603, a high voltage transformer 604, a feedback circuit unit 605 configured to monitor an output voltage via a resistance R17 and set an output voltage value according to setting of the PWM signal, and a reference voltage circuit unit 606 constituted of resistances R11 and R13. A signal is supplied from a charging bias to this circuit via the resistance R12.

Employing the above described configuration enables control of a developing bias according to a change in charging bias. Thus, a constant contrast voltage can be obtained.

An example in which contrast is constant will be described below. In the charging bias circuit, in setting of constants, i.e., Vref: 18 V, R21: 10 kΩ, R23: 50 kΩ, R25: 50 kΩ, R26: 100 kΩ, and R27: 20 MΩ, when a PWM smoothing voltage (V23): 5.5 V is set, a charging bias of −700 V is output.

With respect the above settings of the charging bias, in setting of developing bias constants of Vref: 18 V, R11: 10 kΩ, R13: 50 kΩ, R12: 1 MΩ, R15: 50 kΩ, R16: 100 kΩ, and R17: 4 MΩ, when a PWM smoothing voltage (V3): 2V is set, a current of I2: 709 μA flows from the reference voltage circuit unit 606 of a developing bias to the output terminal of the charging bias application circuit unit 501, and a negative input voltage (Vop) of the operation amplifier becomes 9.09 V because of setting of the Vref and R11 and R13. Based on this value and voltage setting of the PWM smoothing voltage (V3) and Vref, I15: 178 μA, I16: 71 μA, and I17: 107 μA are set. The current of I7: 107 μA flows to R17: 4 MΩ, and hence an output voltage of 4 MΩ*107 μA=−429 V is set. Thus, a contrast voltage becomes Δ271 V (700 V−429 V).

In this setting, when deviation from a Δ20 V center value occurs in charging bias due to constant variance, a charging bias output: −720 V is set. In this case, when the PWM smoothing voltage (V3) of 2 V is set, a current of I12: 729 μA flows from the reference voltage circuit unit 606 of the developing bias to the output terminal of the charging bias application circuit 501, and a negative input voltage (Vop)=8.925 V of the operation amplifier is set because of the setting of Vref and R11 and R13. Based on this value and the voltage setting of the PWM smoothing voltage (V3) and Vref, currents of I15: 181 μA, I16: 69 μA, and I17: 112 μA are set. The current of I17: 112 μA flows to R17: 4 MΩ, and hence an output voltage of 4 MΩ*112 μA=−449 V is set, which is a voltage corresponding to a change amount 20V of the charging bias. The contrast voltage is kept constant at Δ271 V (720 V−449 V).

Tables 3 and 4 describe voltage and current values of the above described points:

TABLE 3

| Reference | | | |
|---|---|---|---|
| Vref (V) | 18 | V13 (V) | 2 |
| R11 (Ω) | 10000 | V14 (V) | 18 |
| R13 (Ω) | 50000 | R15 (Ω) | 50000 |
| R12 (Ω) | 1000000 | R16 (Ω) | 100000 |
| V2 (V) (Charging DC output) | −700 | I15 (A) | 0.000178 |
| | | I16 (A) | −7.1E−05 |

TABLE 3-continued

| Reference | | | |
|---|---|---|---|
| Vop (V) | 9.090909 | I17 (A) | 0.000107 |
| | | R17 (Ω) | 4000000 |
| | | Vout (Developing DC output) | −429 |
| | | Contrast | −271 |

TABLE 4

| Even in the case where load change/component variance causes change in charging can be dealt with | | | |
|---|---|---|---|
| Vref (V) | 18 | V13 (V) | 2 |
| R11 (Ω) | 10000 | V14 (V) | 18 |
| R13 (Ω) | 50000 | R15 (Ω) | 50000 |
| R12 (Ω) | 1000000 | R16 (Ω) | 100000 |
| V2 (V) (Charging DC output) | −720 | I15 (A) | 0.000181488 |
| | | I16 (A) | −6.92562E−05 |
| Vop (V) | 8.92562 | I17 (A) | 0.000112231 |
| | | R17 (Ω) | 4000000 |
| | | Vout (Developing DC output) | −449 |
| | | Contrast | −271 |

Figure 6:
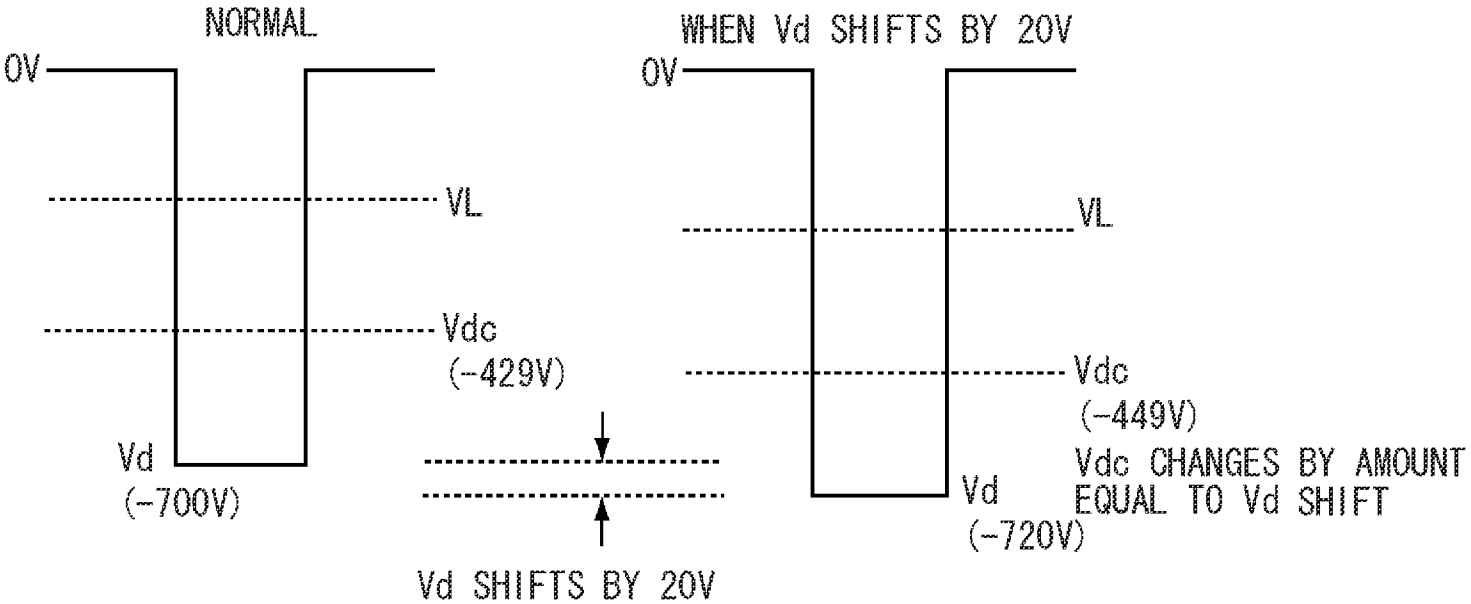
FIG. 6 illustrates potentials of main units according to the second exemplary embodiment.

FIG. 6 illustrates potentials in the above case.

Figure 7:
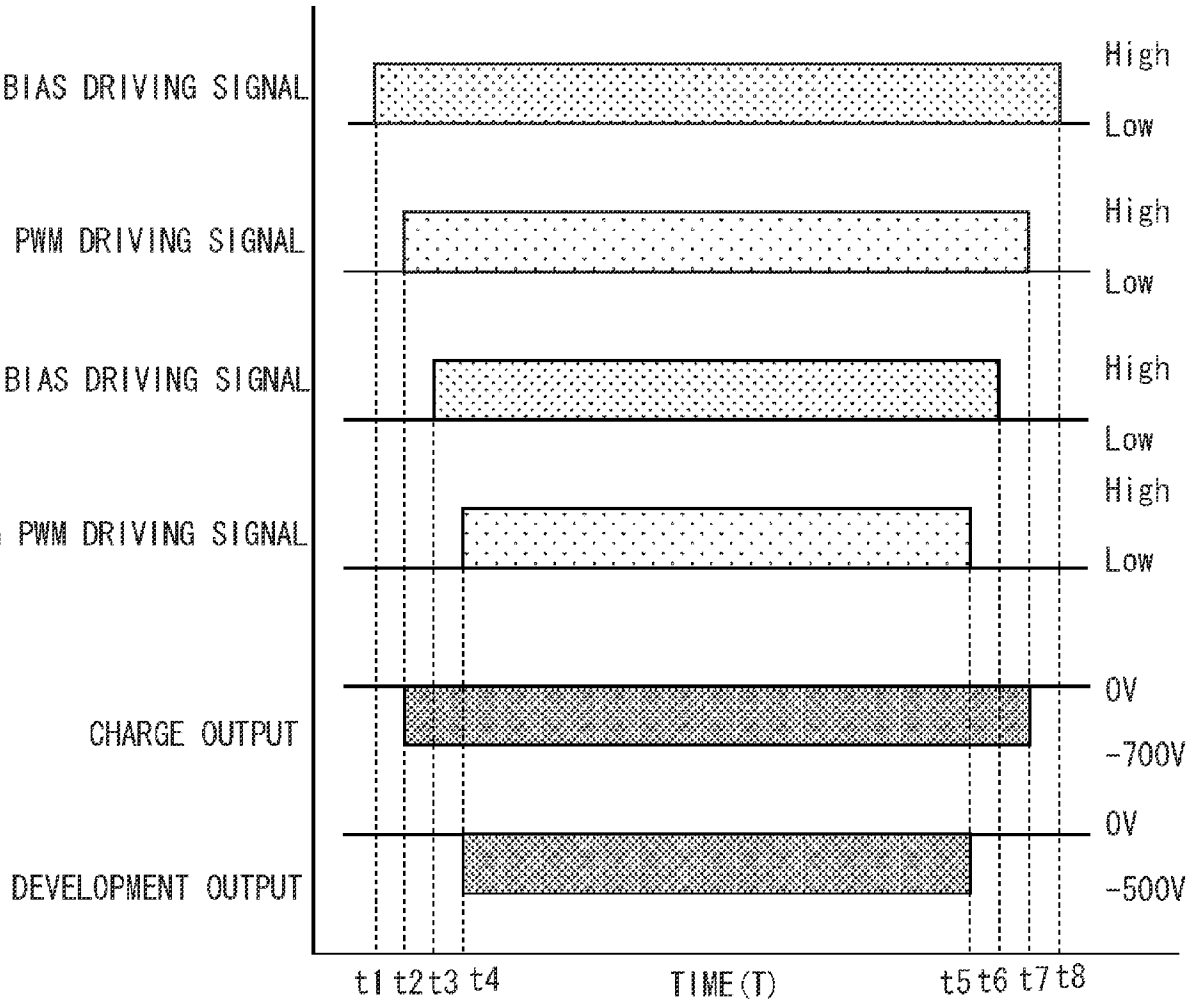
FIG. 7 is a timing chart of the main units according to the second exemplary embodiment.

FIG. 7 is a timing chart of the present exemplary embodiment.

At the time of output rising, a charging bias driving signal ON (t1) and a charging PWM signal ON (t2) are sequentially input, and then a developing bias driving signal ON (t3) and a developing PWM signal ON (t4) are sequentially input. The entry of the signals in this order results in outputting of a charging bias, and subsequent outputting of a developing bias to which a value of the charging bias has been added.

At the time of output falling, in order to surely output a developing bias to which a charging bias has been added during sheet passing, the developing PWM signal and the developing bias driving signal are respectively turned OFF (t5) and (t6). Then, the charging PWM signal and the charging bias driving signal are respectively turned OFF (t7) and (t8) in this order. Turning the signals ON/OFF by such timing enables sure outputting of a developing bias to which a charging bias has been added during sheet passing.

Controlling signal output timing based on the above described circuit structure and constant settings enables output control associating biases with each other (developing DC voltage and charging DC voltage). In other words, even when the potential Vd changes, a potential difference between Vdc and Vd is kept constant, and a potential difference between VL and Vdc is kept constant. Accordingly, a possibility of occurrence of image fogging or image density unevenness can be reduced. Therefore, a constant contrast potential not affected by a tolerance of a charging bias can be obtained, and a high quality image can be formed. A change in image density can be realized by changing setting of PWM of both bias application circuit units.

Next, a third exemplary embodiment will be described.

An image forming apparatus of the third exemplary embodiment will be described. The third exemplary embodiment is an example that includes a development unit configured to develop an image by toner sequentially charged by a development blade having a development blade bias applied thereto and a development sleeve having a developing bias applied thereto. In other words, the image forming apparatus includes a developing bias application circuit configured to apply a developing bias to a development member and a development blade bias application circuit that is a development blade bias power source circuit configured to apply a development blade bias to a development blade member. Each bias circuit includes a high voltage power source configured to stabilize a difference between output values of constant voltage power supplies generated by constant voltage power sources to a predetermined value.

More specifically, an output of a developing bias is applied to a control unit of the development blade bias application circuit via a resistance. Thus, the high voltage power source can control a difference between a developing bias and a development blade bias at constant by performing control to output a development blade bias associated with a developing bias change caused by constant variance of the developing bias or a load change.

Figure 8:
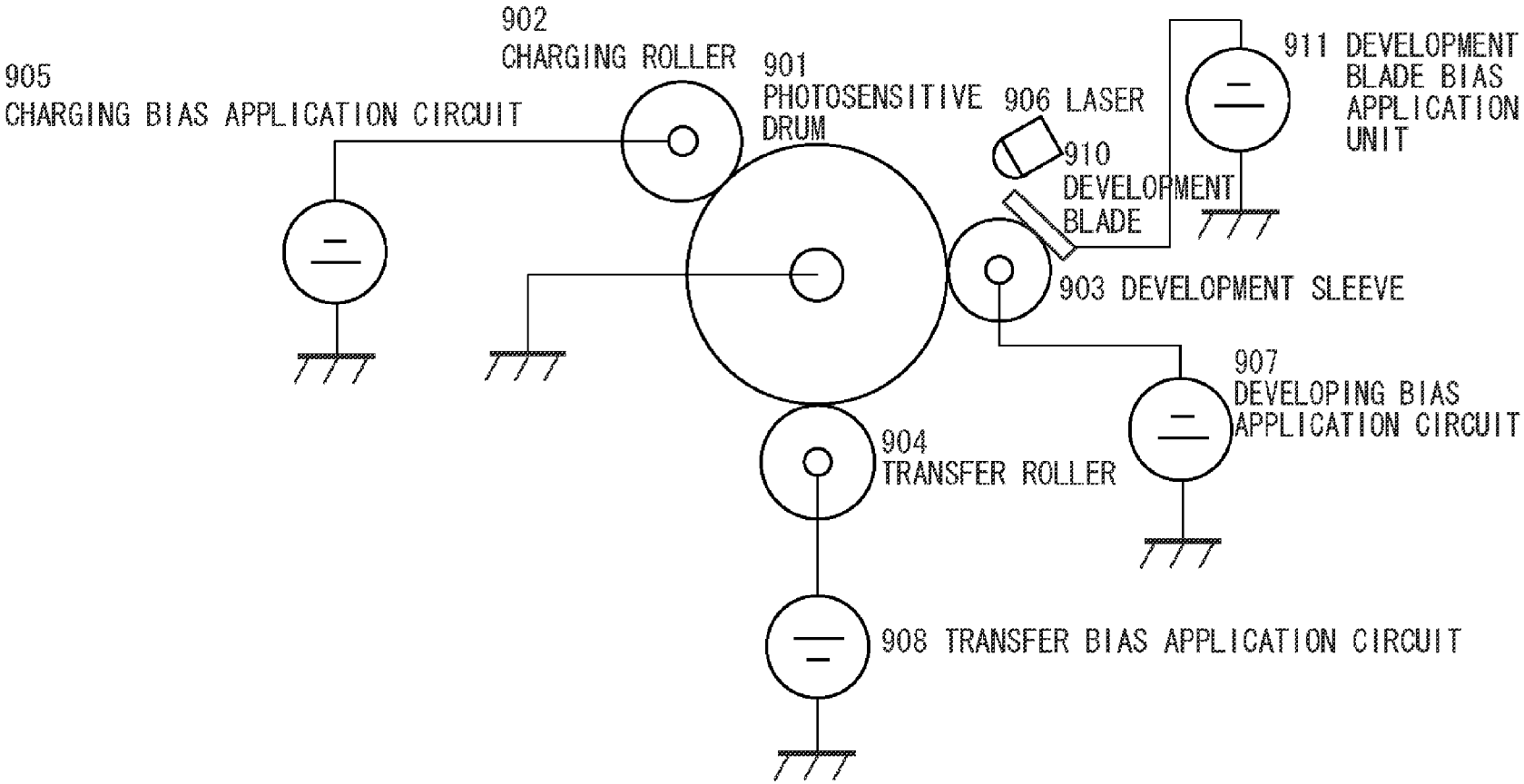
FIG. 8 is a cross sectional diagram schematically illustrating a configuration of an image forming apparatus according to a third exemplary embodiment.

FIG. 8 schematically illustrates a configuration of the image forming apparatus of the present exemplary embodiment. In FIG. 8, the image forming apparatus includes a photosensitive drum 901, a charging roller 902, a development sleeve 903, a transfer roller 904, a charging bias application circuit 905, and a laser light source 906. The image forming apparatus further includes a developing bias application circuit 907, a transfer bias application circuit 908, a development blade 910, and a development blade bias application circuit 911.

The development blade bias is applied for the purpose of charging toner to be negative by rubbing the toner. Thus, a predetermined stable potential difference needs to be set for a bias of a developing roller.

Figure 9:
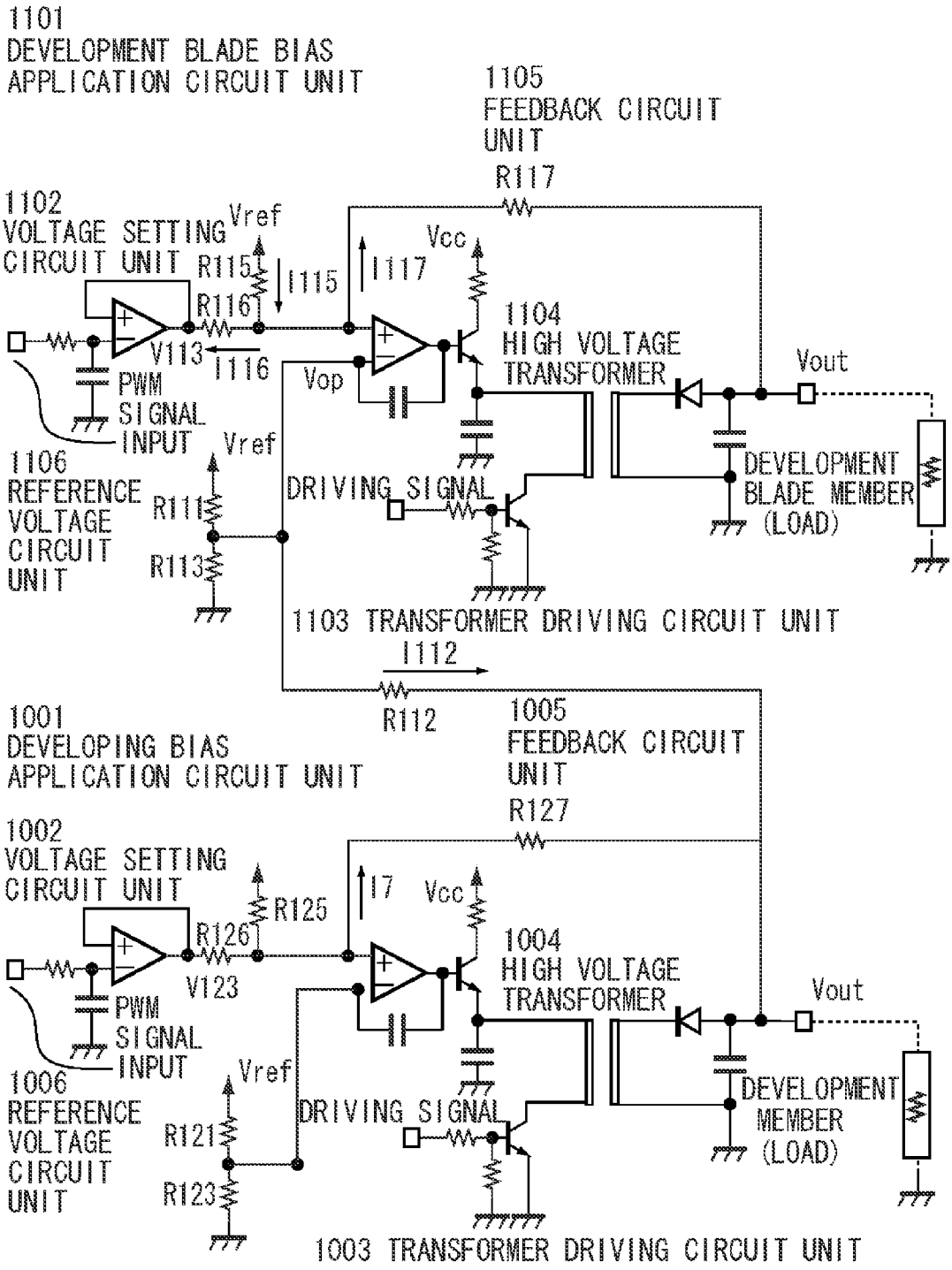
FIG. 9 is a circuit diagram illustrating a developing bias circuit and a developing blade bias circuit according to the third exemplary embodiment.

FIG. 9 schematically illustrates configurations of a developing bias application circuit 1001 and a development blade bias application circuit 1101 that are main portions of the present exemplary embodiment. In the developing bias application circuit 1001, a voltage setting circuit unit 1002 can change a high voltage output according to a PWM signal, and includes a PWM signal smoothing circuit and resistances R125 and R126 for voltage conversion. The developing bias application circuit 1001 includes a transformer driving circuit unit 1003, a high voltage transformer 1004, a feedback circuit unit 1005 configured to monitor an output voltage via a resistance R127 and set an output voltage value according to setting of the PWM signal. The developing bias application circuit unit 1001 further includes a reference voltage circuit unit 1006 constituted of resistances R121 and R123. The feedback circuit unit 1005 includes a resistance R112 configured to reflect a developing bias output in the development blade bias application circuit. These circuit components constitute the developing bias circuit.

In the development blade bias application circuit 1101, a voltage setting circuit unit 1102 can change a high voltage output according to a PWM signal, and includes a PWM signal smoothing circuit and resistances R115 and R116 for voltage conversion. The development bade bias application circuit 1101 includes a transformer driving circuit unit 1103, a high voltage transformer 1104, and a feedback circuit unit 1105 configured to monitor an output voltage via a resistance R117 and set an output voltage value according to setting of the PWM signal. The development bade bias application circuit 1101 further includes a reference voltage circuit unit 1106 constituted of resistances R111 and R113. A signal is supplied from the developing bias application circuit unit 1001 to the reference voltage circuit unit 1106 via the resistance R112.

Employing the above described configuration enables control of a development blade bias according to a change in developing bias. Thus, a constant image density can be obtained.

An example in which a difference between a developing bias and a development blade bias is constant will be described below. In the developing bias circuit, in setting of constants, i.e., Vref: 18 V, R121: 10 kΩ, R123: 50 kΩ, R125: 50 kΩ, R126: 100 kΩ, and R127: 20 MΩ, when a PWM smoothing voltage (V123): 7.5 V is set, a developing bias of −300 V is output.

With respect the above settings of the developing bias, in setting of development blade bias constants of Vref: 18 V, R111: 10 kΩ, R113: 50 kΩ, R112: 1 MΩ, R115: 50 kΩ, R116: 100 kΩ, and R117: 4 MΩ, when a PWM smoothing voltage (V113): 13.7 V is set, a current of I112: 312.4 μA flows from the reference voltage circuit unit of a development blade bias to a developing bias, and a negative input voltage (Vop) of the operation amplifier becomes 12.4 V because of setting of the Vref and R111 and R113. Based on this value and voltage setting of the PWM smoothing voltage (V113) and Vref, I115: 112 μA, I116: 13 μA, and I117: 125 μA are set. The current of I117: 115 μA flows to R117: 4 MΩ, and hence an output voltage of 4 MΩ*125 μA=−500 V is set. Thus, a potential difference becomes Δ200 V (500 V−300 V).

In this setting, when a change of Δ20 V occurs in developing bias due to a load change or transformer variance, a development blade bias output: −520 V is set. In this case, when the PWM smoothing voltage (V113): 13.7 V is set, a current of I112: 332.2 μA flows from the reference voltage circuit unit of the development blade bias to the developing bias, and an input voltage (Vop): 12.23 V of the operation amplifier is set because of setting of Vref and R111 and R113. Based on this value and the voltage setting of the PWM smoothing voltage (V113) and Vref, currents of I115: 115 μA, I116: 14.7 μA, and I117: 130 μA are set. The current of I117: 130 μA flows to R117: 4 MΩ, and hence an output voltage of 4 MΩ*130 μA=−520 V is set, which is a voltage corresponding to a change amount 20 V of the developing bias. The potential difference is kept constant at Δ200V (520 V−320 V).

Tables 5 and 6 describe voltage and current values of these points:

TABLE 5

| Reference | | | |
|---|---|---|---|
| Vref (V) | 18 | V113 (V) | 13.7 |
| R111 (Ω) | 10000 | V114 (V) | 18 |
| R113 (Ω) | 50000 | R115 (Ω) | 50000 |
| R112 (Ω) | 1000000 | R116 (Ω) | 100000 |
| V2 (V) (Developing DC output) | −300 | I115 (A) | 0.000112 |
| | | I116 (A) | 1.3E−05 |
| Vop (V) | 12.39669 | I117 (A) | 0.000125 |
| | | R117 (Ω) | 4000000 |
| | | Vout (Development blade DC output) | −500 |
| | | Contrast | 200 |

TABLE 6

| Even in the case where load change/component variance causes change in charging can be dealt with | | | |
|---|---|---|---|
| Vref (V) | 18 | V113 (V) | 13.7 |
| R111 (Ω) | 10000 | V114 (V) | 18 |

TABLE 6-continued

| Even in the case where load change/component variance causes change in charging can be dealt with | | | |
|---|---|---|---|
| R113 (Ω) | 50000 | R115 (Ω) | 50000 |
| R112 (Ω) | 1000000 | R116 (Ω) | 100000 |
| V2 (V) (Developing DC output) | −320 | I115 (A) | 0.000115 |
| | | I116 (A) | 1.47E−05 |
| Vop (V) | 12.2314 | I117 (A) | 0.00013 |
| | | R117 (Ω) | 4000000 |
| | | Vout (Development blade DC output) | −520 |
| | | Contrast | 200 |

Figure 10:
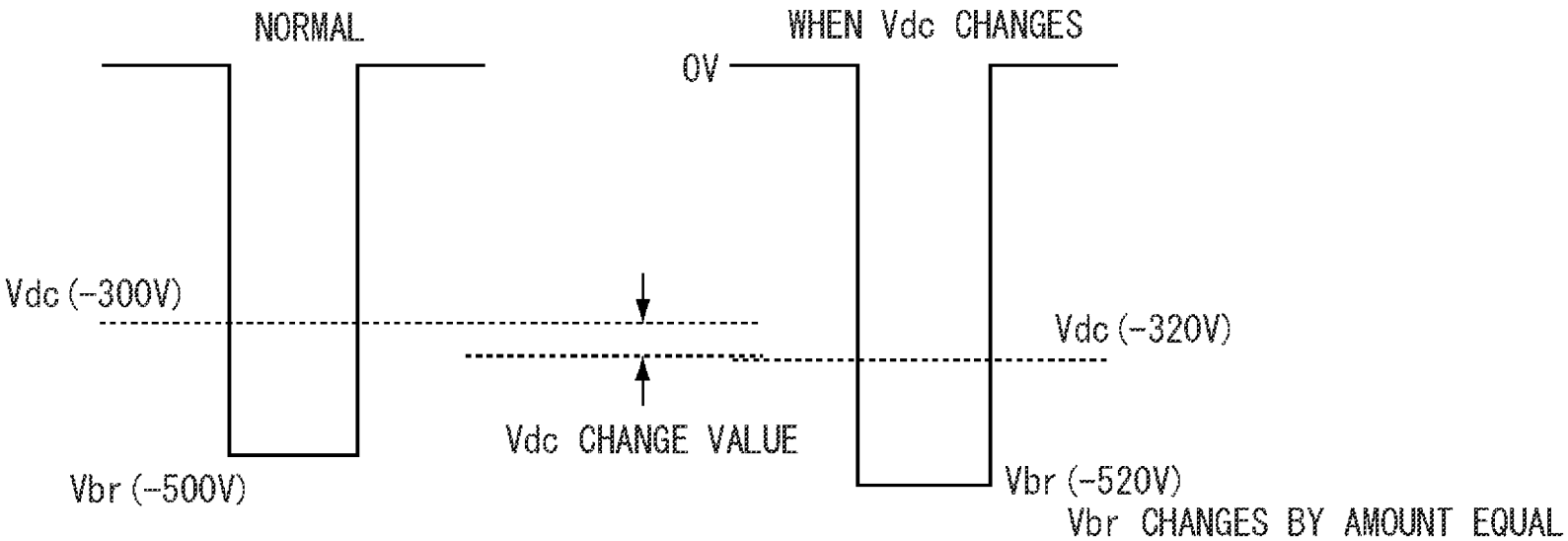
FIG. 10 illustrates potentials of main units according to the third exemplary embodiment.

FIG. 10 illustrates potentials in the above case.

Figure 11:
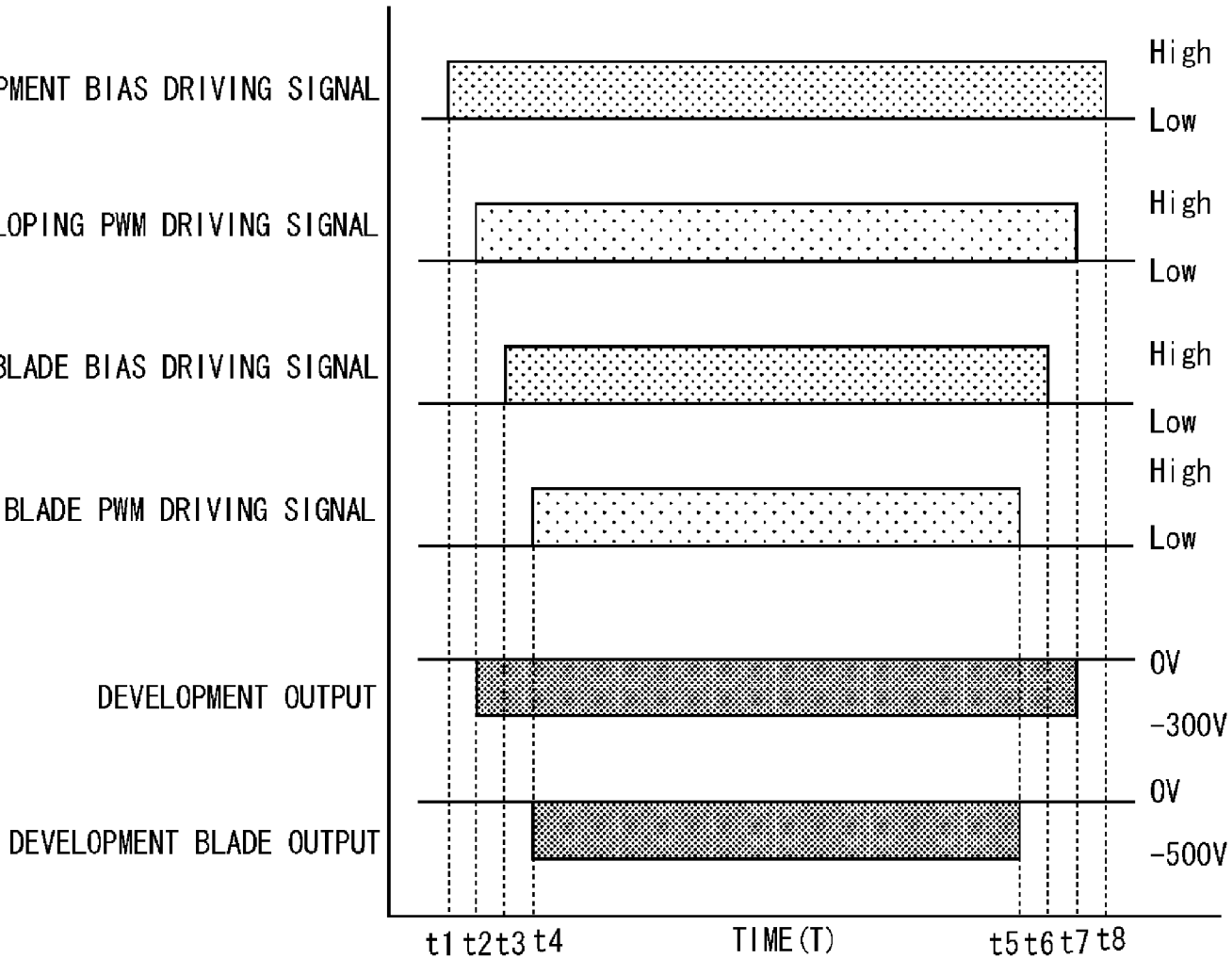
FIG. 11 is a timing chart of the main units according to the third exemplary embodiment.
Figure 12:
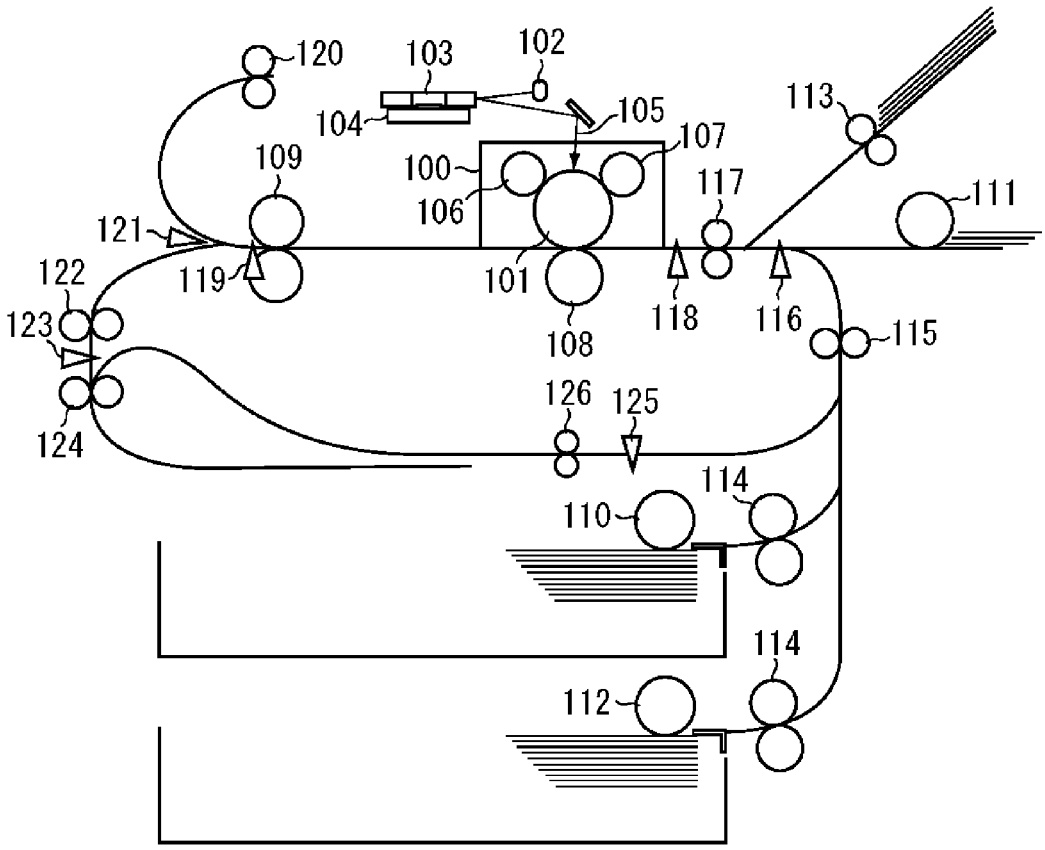
FIG. 12 is a cross sectional diagram illustrating a configuration of an image forming apparatus main body.
Figure 13:
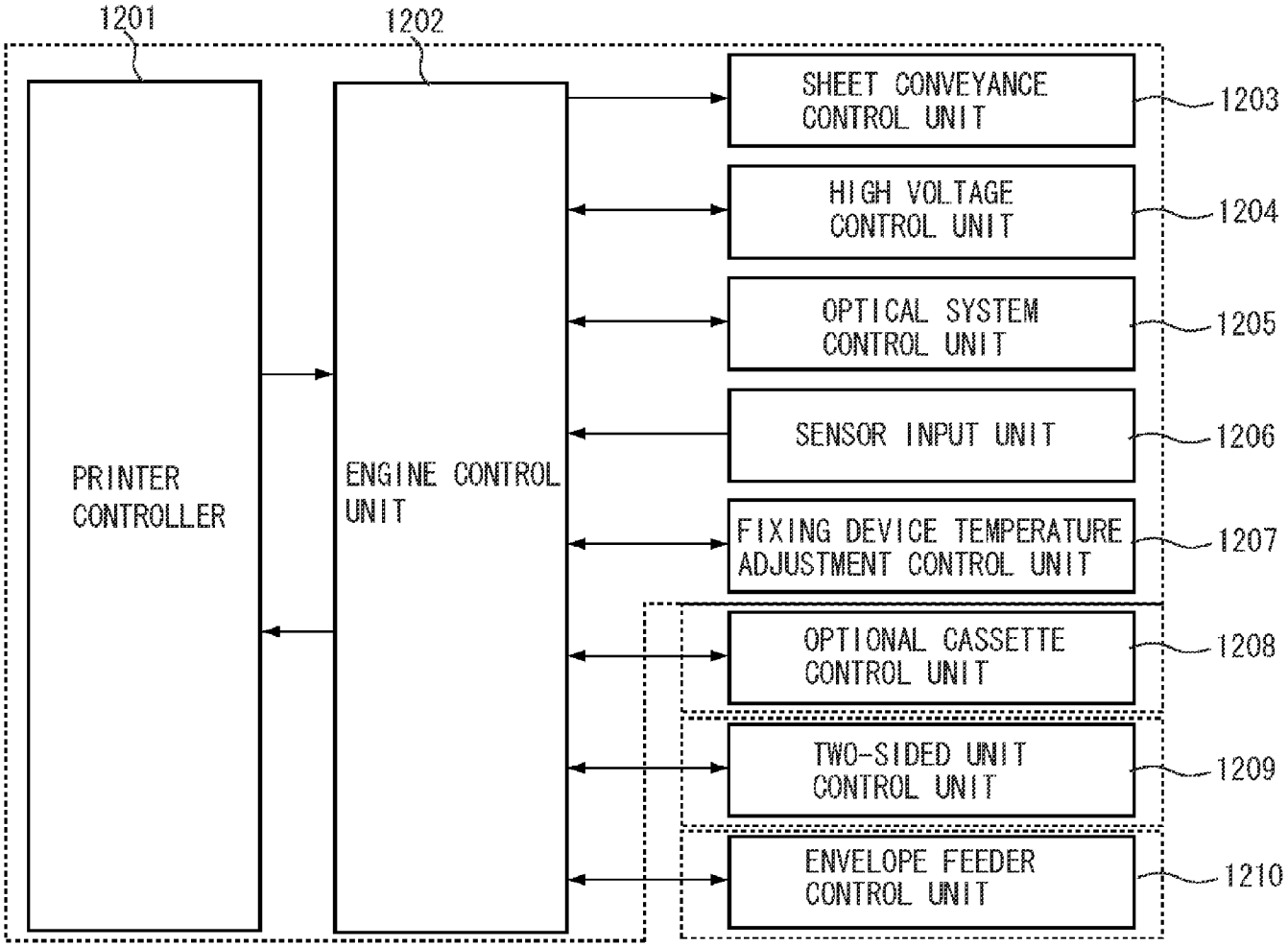
FIG. 13 PRIOR ART
FIG. 13 is a block diagram illustrating a configuration of a controller unit of an image forming apparatus.
Figure 14:
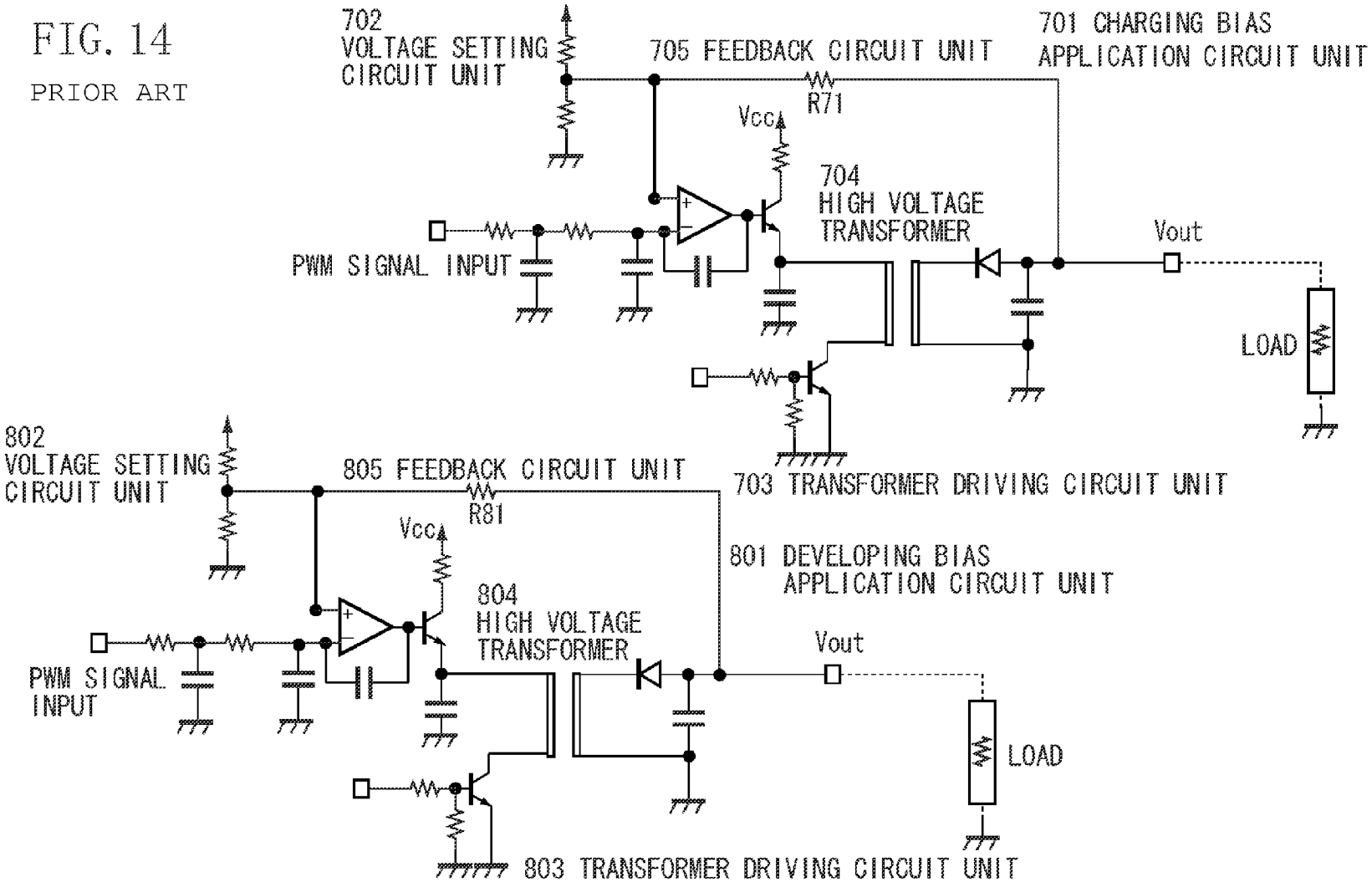
FIG. 14 PRIOR ART
FIG. 14 is a circuit diagram illustrating a charging bias circuit and a developing bias circuit according to a conventional example.
Figure 15A:
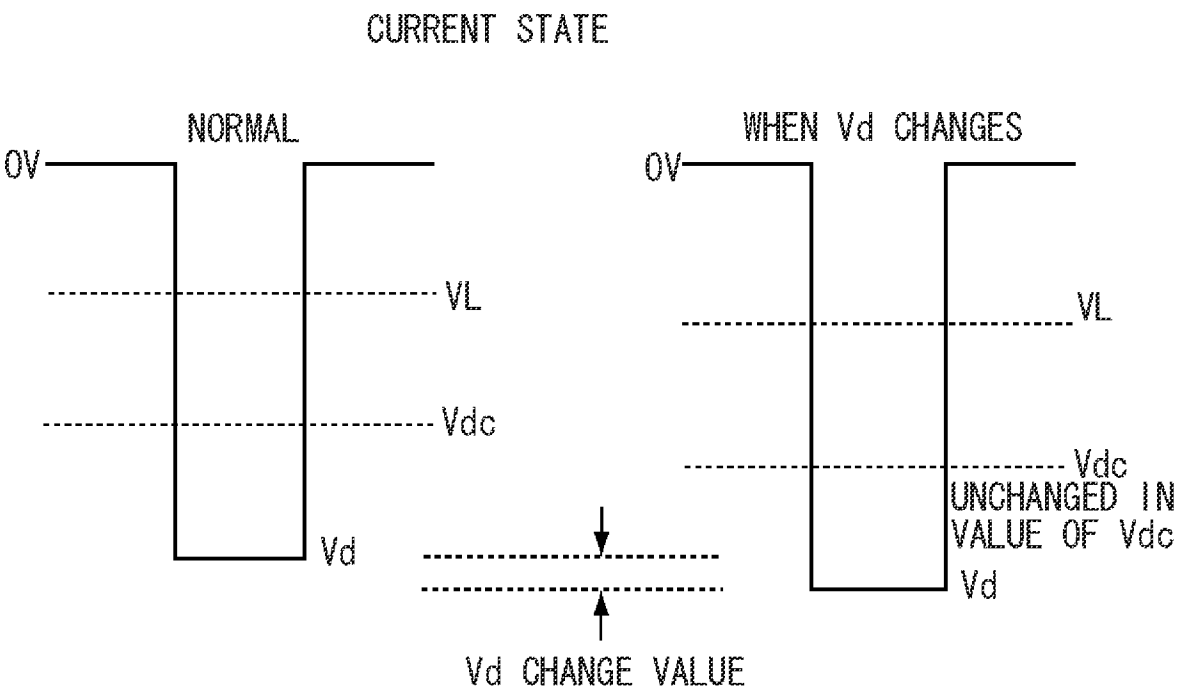
FIGS. 15A and 15B illustrate potentials of related bias circuits.
Figure 15B:
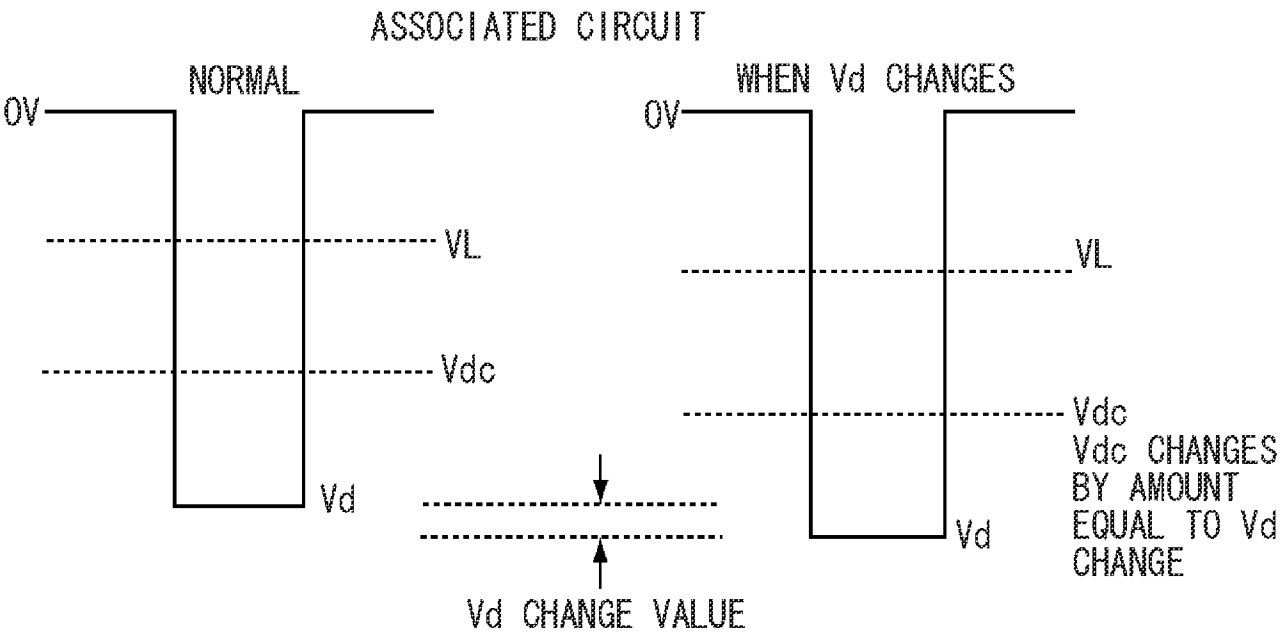
Figure 16A:
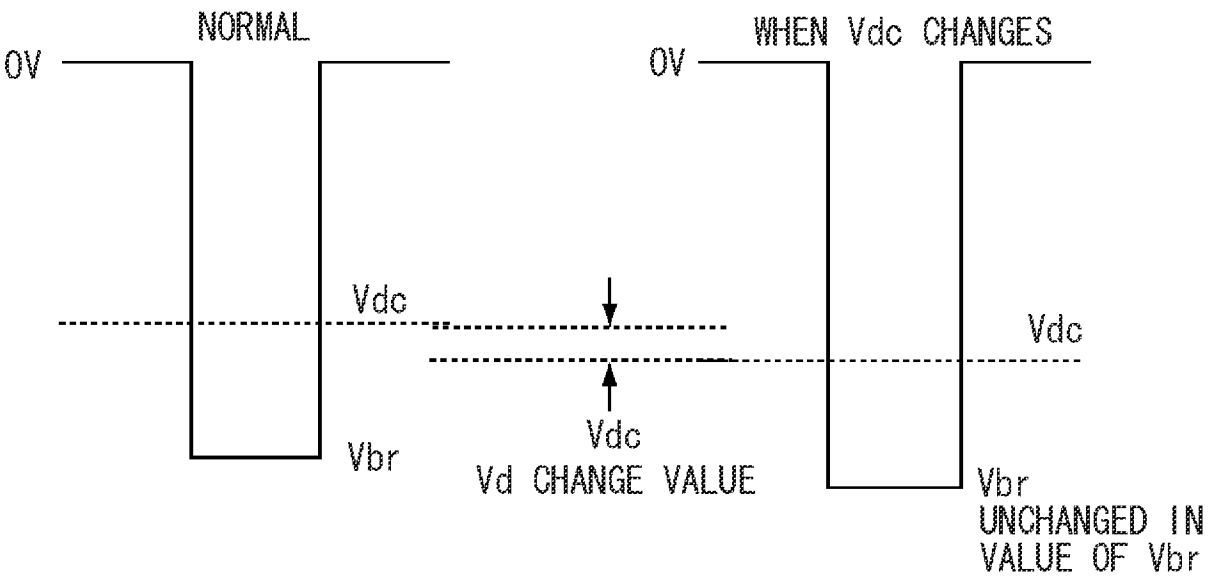
FIGS. 16A and 16B illustrate potentials of related bias circuits.
Figure 16B:
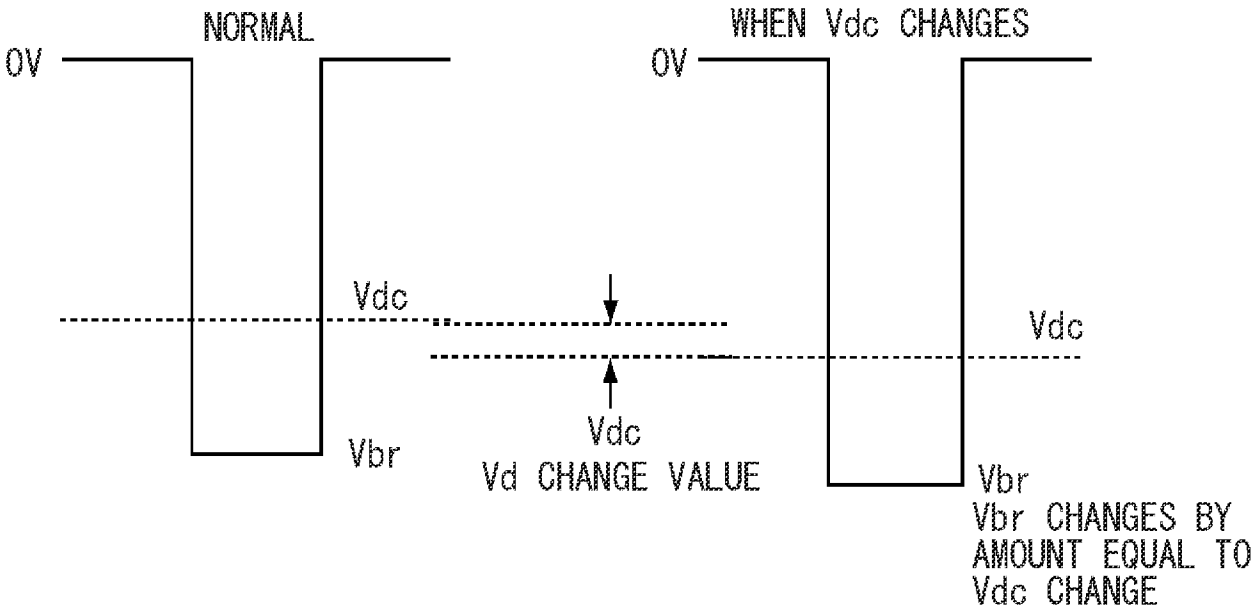

FIG. 11 is a timing chart of the present exemplary embodiment.

At the time of output rising, a developing bias driving signal ON (t1) and a developing PWM signal ON (t2) are sequentially input, and then a development blade bias driving signal ON (t3) and a development blade PWM signal ON (t4) are sequentially input. The entry of the signals in this order results in outputting of a developing bias, and subsequent outputting of a development blade bias to which a value of the developing bias has been added.

At the time of output falling, in order to surely output a development blade bias to which a developing bias has been added during sheet passing, the developing PWM signal and the development blade bias driving signal are respectively turned OFF (t5) and (t6). Then, the developing PWM signal and the developing bias driving signal are respectively turned OFF (t7) and (t8) in this order. Turning the signals ON/OFF by such timing enables sure outputting of a development blade bias to which a developing bias has been added during sheet passing.

Controlling signal output timing based on the above described circuit structure and constant settings enables output control associating biases with each other (developing DC voltage and development blade voltage). In other words, even when the potential Vdc changes, a potential difference between Vdc and Vbr is kept constant, and toner can be charged by an appropriate potential. (No margin is reduced with respect to a potential for toner charging). Therefore, a constant potential difference not affected by a tolerance of a developing bias can be obtained, and a high quality image can be formed. A change in image density can be realized by changing setting of PWM of both bias application circuit units.

In the above described exemplary embodiments, each bias circuit outputs a DC voltage. However, the bias circuit can output a voltage in which an alternating current (AC) component voltage is superimposed thereon. Each bias circuit outputs a constant voltage. However, the bias circuit can output a constant current.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-086116 filed Mar. 31, 2009, which is hereby incorporated by reference herein in its entirety.

What is claimed is:

1. An image forming apparatus having an image bearing member, a charging unit configured to charge the image bearing member, a latent image forming unit configured to form an electrostatic latent image on the image bearing member charged by the charging unit, and a development unit configured to develop the electrostatic latent image formed on the image bearing member by a developer, the image forming apparatus comprising:

a charging voltage generation unit configured to generate a charging voltage to be applied to the charging unit;

a developing voltage generation unit configured to generate a developing voltage to be applied to the development unit, the developing voltage generation unit including a driving part for driving the developing voltage generation unit according to a setting signal to be input; and a correction unit configured to change the output from the developing voltage generation unit in conjunction with a change of an output from the charging voltage generation unit, wherein the correction unit is connected to a voltage output part of the charging voltage generation unit and the driving part of the developing voltage generation unit.

2. The image forming apparatus according to claim 1, wherein the driving part drives the developing voltage generation unit based on the setting signal and the output from the developing voltage generation unit and a reference value, and the correction unit corrects the reference value so as to change the developing voltage.

3. The image forming apparatus according to claim 1, further comprising, a feedback unit configured to control the output from the charging voltage generation unit based on the output from the charging voltage generation unit and a reference value.

4. The image forming apparatus according to claim 1, further comprising:

an image forming unit configured to form an image; and a controller configured to control an operation of the image forming unit, wherein the controller outputs the setting signal to the voltage setting part of the developing voltage generation unit.

5. The image forming apparatus according to claim 1, wherein the developing voltage generation unit comprises a transformer, and wherein the driving part is arranged at a primary side of the transformer.

6. An image forming apparatus having an image bearing member, a development unit configured to supply a developer to an electrostatic latent image formed on the image bearing member, and a development member configured to charge the developer, the image forming apparatus comprising:

a first developing voltage generation unit configured to generate a first developing voltage to be applied to the development unit;

a second developing voltage generation unit configured to generate a second developing voltage to be applied to the development member; and a correction unit configured to change the output from the second developing voltage unit in conjunction with a change of an output from the first developing voltage generation unit.

7. The image forming apparatus according to claim 6, wherein the control unit comprises a feedback unit configured to control the output from the second developing voltage generation unit based on the output from the second developing voltage generation unit and a reference value, and the correction unit corrects the reference value so as to change the second developing voltage.

8. The image forming apparatus according to claim 6, further comprising, a feedback unit configured to control the output from the first developing voltage generation unit based on the output from the first developing voltage generation unit and a reference value.

9. The image forming apparatus according to claim 6, wherein the second developing voltage generation unit includes a driving part for driving the second developing voltage generation unit according to a setting signal to be input, and wherein the correction unit is connected to a voltage output part of the first developing voltage generation unit and the driving part of the second developing voltage generation unit.

10. The image forming apparatus according to claim 9, further comprising:

an image forming unit configured to form an image; and a controller configured to control an operation of the image forming unit, wherein the controller outputs the setting signal to the driving part of the second developing voltage generation unit.

11. A power source for supplying a high voltage, comprising:

a charging voltage generation unit configured to generate a charging voltage to be applied to a charging unit for charging an image bearing member;

a developing voltage generation unit configured to generate a developing voltage to be applied to a development unit for developing an electrostatic latent image formed on the image bearing member by a developer, the developing voltage generation unit including a driving part for driving the developing voltage generation unit according to a setting signal to be input; and a correction unit configured to change the output from the developing voltage generation unit in conjunction with a change of an output from the charging voltage generation unit, wherein the correction unit is connected to a voltage output part of the charging voltage generation unit and the driving part of the developing voltage generation unit.

12. The power source according to claim 11, wherein the driving part drives the developing voltage generation unit based on the setting signal and the output from the developing voltage generation unit and a reference value, and the correction unit corrects the reference value so as to change the developing voltage.

13. The power source according to claim 11, further comprising, a feedback unit configured to control the output from the charging voltage generation unit based on the output from the charging voltage generation unit and a reference value.

14. The power source according to claim 11, further comprising:

a controller configured to output the setting signal to the driving part.

15. The image forming apparatus according to claim 11, wherein the developing voltage generation unit comprises a transformer, and wherein the driving part is arranged at a primary side of the transformer.

16. A power source for supplying a high voltage, comprising:

a first developing voltage generation unit configured to generate a first developing voltage to be applied to a development unit for developing an electrostatic latent image formed on an image bearing member by a developer;

a second developing voltage generation unit configured to generate a second developing voltage to be applied to a development member for charging the developer; and a correction unit configured to change the output from the second developing voltage generation unit in conjunction with a change of an output from the first developing voltage generation unit.

17. The power source according to claim 16, wherein the control unit includes a feedback unit configured to control the output from the second developing voltage generation unit based on the output from the second developing voltage generation unit and a reference value, and the correction unit corrects the reference value so as to change the second developing voltage.

18. The power source according to claim 16, further comprising, a feedback unit configured to control the output from the first developing voltage generation unit based on the output from the first developing voltage generation unit and a reference value.

19. The power source according to claim 16, wherein the second developing voltage generation unit includes a driving part for driving the second developing voltage generation unit according to a setting signal to be input, and wherein the correction unit is connected to a voltage output part of the first developing voltage generation unit and the driving part of the first developing voltage generation unit.

20. The power source according to claim 19, further comprising:

a controller configured to output the setting signal to the driving part.

* * * * *